US007094296B1

(12) United States Patent
Williams et al.

(10) Patent No.: US 7,094,296 B1
(45) Date of Patent: Aug. 22, 2006

(54) GAS GENERANTS CONTAINING SILICONE FUELS

(75) Inventors: Graylon K. Williams, Warren, MI (US); Sean P. Burns, Almont, MI (US)

(73) Assignee: Automotive Systems Laboratory, Inc., Farmington Hills, MI (US)

( * ) Notice: Subject to any disclaimer, the term of this patent is extended or adjusted under 35 U.S.C. 154(b) by 551 days.

(21) Appl. No.: 09/664,130

(22) Filed: Sep. 18, 2000

Related U.S. Application Data

(60) Provisional application No. 60/154,242, filed on Sep. 16, 1999, provisional application No. 60/154,293, filed on Sep. 16, 1999.

(51) Int. Cl.
*C06B 45/10* (2006.01)
*C06B 31/00* (2006.01)

(52) U.S. Cl. ..... 149/19.2; 280/741

(58) Field of Classification Search ..... 149/19.2; 280/741

See application file for complete search history.

(56) References Cited

U.S. PATENT DOCUMENTS

| | | | | | |
|---|---|---|---|---|---|
| 3,453,156 | A | | 7/1969 | Hackett et al. | 149/19 |
| 3,845,970 | A | | 11/1974 | Herrmann | 280/150 AB |
| 3,912,562 | A | * | 10/1975 | Garner | 149/41 |
| 3,964,256 | A | | 6/1976 | Plantif et al. | 60/219 |
| 3,986,908 | A | | 10/1976 | Grebert et al. | 149/19.7 |
| 4,101,352 | A | * | 7/1978 | Poulin et al. | 149/19.2 |
| 4,309,229 | A | | 1/1982 | Hamilton | 149/82 |
| 4,332,631 | A | | 6/1982 | Herty, III et al. | 149/19.2 |
| 5,538,568 | A | * | 7/1996 | Taylor et al. | 149/70 |
| 5,542,704 | A | * | 8/1996 | Hamilton et al. | 280/741 |
| 5,589,662 | A | * | 12/1996 | Schleicher et al. | 149/35 |
| 5,610,444 | A | * | 3/1997 | Austruy et al. | 264/3.3 |
| 5,629,494 | A | * | 5/1997 | Barnes et al. | 149/36 |
| 5,656,793 | A | | 8/1997 | Ochi et al. | 149/22 |
| 5,681,904 | A | * | 10/1997 | Manzara | 525/404 |
| 5,682,014 | A | * | 10/1997 | Highsmith et al. | 149/36 |
| 5,731,540 | A | * | 3/1998 | Flanigan et al. | 149/109.6 |
| 5,738,374 | A | | 4/1998 | Marsaud et al. | 280/741 |
| 5,847,311 | A | | 12/1998 | Ryder | 102/288 |
| 5,962,808 | A | * | 10/1999 | Lundstrom | 149/19.1 |
| 6,019,861 | A | * | 2/2000 | Canterberry et al. | 149/19.1 |
| 6,029,994 | A | | 2/2000 | Perotto et al. | 280/736 |
| 6,143,104 | A | | 11/2000 | Blomquist | 149/61 |
| 6,481,746 | B1 | * | 11/2002 | Hinshaw et al. | 280/741 |
| 6,547,900 | B1 | * | 4/2003 | Canterberry et al. | 149/109.6 |
| 6,805,377 | B1 | * | 10/2004 | Krupp et al. | 280/741 |
| 6,960,268 | B1 | * | 11/2005 | Mendenhall et al. | 149/19.2 |
| 6,979,022 | B1 | * | 12/2005 | Smith et al. | 280/741 |
| 2001/0045735 | A1 | * | 11/2001 | Krupp et al. | 280/741 |
| 2004/0084885 | A1 | * | 5/2004 | Burns et al. | 280/741 |
| 2004/0231767 | A1 | * | 11/2004 | Mendenhall et al. | 149/19.2 |
| 2004/0232678 | A1 | * | 11/2004 | Smith et al. | 280/741 |
| 2005/0052007 | A1 | * | 3/2005 | Blackburn et al. | 280/737 |
| 2005/0082805 | A1 | * | 4/2005 | Blackburn | 280/737 |
| 2005/0104349 | A1 | * | 5/2005 | Stevens et al. | 280/741 |
| 2005/0110253 | A1 | * | 5/2005 | Khandhadia et al. | 280/736 |
| 2005/0116454 | A1 | * | 6/2005 | Stevens et al. | 280/741 |
| 2005/0223932 | A1 | * | 10/2005 | Blackburn | 102/531 |

FOREIGN PATENT DOCUMENTS

| | | | |
|---|---|---|---|
| WO | WO 99/31029 | * | 6/1999 |

* cited by examiner

*Primary Examiner*—Katherine Mitchell
(74) *Attorney, Agent, or Firm*—L.C. Begin & Associates, PLLC

(57) ABSTRACT

Gas generating compositions are provided containing silicone, a metal or nonmetal perchlorate oxidizer, and a coolant selected from the group including metal carbonates, metal bicarbonates, metal oxalates, and metal hydroxides. These compositions exhibit rapid and sustained burn rates at ambient pressure while maintaining acceptable combustion temperatures.

13 Claims, No Drawings

GAS GENERANTS CONTAINING SILICONE FUELS

CROSS-REFERENCE TO RELATED APPLICATIONS

This application claims the benefit of U.S. Provisional Application Ser. Nos. 60/154,242 and 60/154,293 filed Sep. 16, 1999.

BACKGROUND OF THE INVENTION

Field of the Invention

The present invention generally relates to gas generant compositions for inflators of occupant restraint systems. High gas yield gas generants often lose large amounts of heat to the inflator body and surroundings during combustion, and thereby result in a lower generant burn rate and a reduced performance. Compositions provided in accordance with the present invention exhibit a rapid and sustained burn at ambient pressure. Other benefits may include a relatively lower combustion temperature and/or an increase in the moles of gas produced per gram of gas generant composition.

Certain applications incorporating gas generation require a relatively fast burn at ambient pressure, as compared to known nonazide gas generant compositions. Many known nonazide compositions simply cannot sustain a combustion burn rate, adequate for inflation of an airbag for example, under ambient conditions. To overcome this disadvantage, combustion must occur in pressurized conditions. As a result, the combustion vessel (an airbag gas generator for example) must be manufactured to accommodate pressures of 1000 pounds per square inch (psi) or greater. The need to pressurize the combustion vessel during combustion requires a more robust inflator and therefore increases the manufacturing costs.

Certain gas generant compositions or propellants containing silicone and a perchlorate oxidizer (compositions containing silicone and potassium perchlorate, for example) exhibit a relatively rapid burn rate and sustainable combustion at ambient pressure. Nevertheless, to sustain combustion, the combustion temperature is quite hot. As a result, these compositions are not suitable for certain applications unless an adequate heat sink is also provided. Therefore, the manufacturing cost of the inflator or combustion vessel again increases.

Silicone as a fuel is advantageous over other known nonazide fuels known to be useful in occupant restraint systems, for example. Because silicone does not contain nitrogen, undesirable nitrogen oxides are reduced or eliminated as combustion products. Additionally, silicone also provides elasticity to the gas generant composition thereby reducing the propensity for fracture of the gas generant over time. Finally, silicone aids in sustaining combustion at ambient pressure.

Therefore, a gas generant composition utilizing silicone as a primary fuel and yet exhibiting a rapid and sustained burn rate along with an acceptable combustion temperature would be an improvement in the art.

SUMMARY OF THE INVENTION

The above-referenced problems are resolved by gas generant compositions containing silicone as a fuel; an oxidizer selected from the group including metal and nonmetal perchlorates such as potassium perchlorate, lithium perchlorate, and ammonium perchlorate; and, a coolant selected from the group including metal carbonates, metal bicarbonates, metal oxalates, and metal hydroxides. In accordance with the present invention, the addition of a coolant to a composition containing a perchlorate oxidizer and a silicone fuel results in a composition that combusts at rapid and sustained burn rates at ambient pressure. Additionally, the combustion temperature is substantially lower than other state of the art compositions.

Preferred gas generant compositions contain coolants having more negative heats of formation. Stated another way, preferred coolants of the present invention will preferably exhibit a relatively greater negative heat of formation. Accordingly, dissociation of the coolant upon combustion of the gas generant composition results in an endothermic combustion reaction thereby resulting in a cooler combustion temperature. Furthermore, when coolants such as strontium carbonate are employed, strontium silicate is formed thereby forming an insulation around the propellant as it burns. As a result, the heat that is released upon combustion is conserved by the insulating effect of the metal silicate. Although strontium carbonate is the most preferred coolant, other metal salts also exhibit similar characteristics.

DESCRIPTION OF THE PREFERRED EMBODIMENT(S)

In accordance with the present invention, compositions containing at least one silicone polymer (organosiloxane polymers) as a fuel, at least one oxidizer, and at least one coolant component containing a metallic salt and/or base, combust at ambient pressure at acceptable combustion temperatures.

Silicone is defined as any of a large group of siloxane polymers based on a structure consisting of alternate silicon and oxygen atoms with various organic radicals (or functional groups) attached to the silicon. Radicals include, but are not limited by the group including methyl, methoxy, and amino.

The term "silicone" as used herein will be understood in its generic sense. Hawley describes silicone (organosiloxane) as any of a large group of siloxane polymers based on a structure consisting of alternate silicon and oxygen atoms with various organic radicals attached to the silicon:

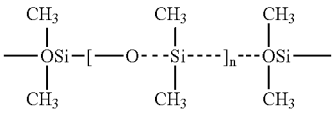

Formula 1 Silicone Example

Or, silicone can be more generically represented as shown in Formula 2:

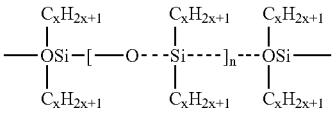

Formula 2: Silicone Example

Note, "n" in the Formulas indicates a multiple of the polymeric group or portion of the molecule given within the brackets, to include the organic groups attached to the silicon.

Exemplary silicones include those disclosed in U.S. Pat. Nos. 5,589,662, 5,610,444, and 5,700,532, and, in TECHNOLOGY OF POLYMER COMPOUNDS AND ENERGETIC MATERIALS, Fraunhofer-Institut fur Chemische Technologie (ICT), 1990, each reference and document herein incorporated by reference.

The compositions of the present invention contain silicone as a fuel. The fuel component is provided at 10–25% by weight of the gas generant composition.

The gas generant compositions of the present invention contain one or more primary oxidizers selected from the group including metal and nonmetal perchlorates.

If desired, exemplary secondary oxidizers include but are not limited to phase stabilized ammonium nitrate, ammonium nitrate, potassium nitrate, and strontium nitrate. Stated another way, secondary oxidizers may be selected from the group including metal and nonmetal chlorates, oxides, nitrates, and nitrites, or other well known oxidizers.

A coolant is selected from the group including metal carbonates, metal oxalates, metal bicarbonates, and metal hydroxides. "Metal" is defined as alkali, alkaline earth, and transitional metals. Exemplary coolants include but are not limited to strontium carbonate, magnesium carbonate, calcium carbonate, potassium carbonate, strontium oxalate, and magnesium hydroxide.

An additional benefit of the coolant is that upon combustion, the resulting metal and silicate ions formed during combustion will form metal silicates. As a result, a coating will form within the combustion chamber and insulate the propellant within the pressure vessel thereby conserving the heat of reaction and contributing to a strong and sustained burn rate at ambient pressure.

Preferred compositions include silicone, a metal perchlorate oxidizer, and an alkaline earth carbonate. A most preferred composition contains silicone, potassium perchlorate, and strontium carbonate. This composition results in the formation of strontium silicates. The substantial negative heat of formation of strontium carbonate results in an endothermic combustion reaction. As a result the combustion temperature is reduced counters the heat loss that generally results from high gas yield gas generants.

Metal silicates are formed upon combustion of the gas generant compositions containing silicone and metal salts as coolants. Strontium silicates (or other metal silicates) function as ceramic insulators. Therefore, the metal silicates formed upon combustion insulate the propellant chamber thereby maintaining sufficient heat proximate to the burning surface of the propellant and improving combustion characteristics. As such, the heat of combustion is endothermically minimized by the negative heat of formation of the coolant, and is then retained during combustion by the additional insulating benefit.

The gas generant composition contains 10–25% by weight of silicone, 30–85% by weight of a primary oxidizer, and 1–30% by weight of a coolant. If desired, one or more secondary oxidizers are employed at 30–50% by weight of the gas generant composition. The gas generant constituents in similarly sized granular or smaller particulates are added to a tumble blender at 100° C. and homogeneously blended, preferably for at least two hours. Silicone is preferably added as a resin that is previously blended with a curing agent. In general, the order in which the constituents are added is not critical so long as they are homogeneously blended. Other known wet and dry blending methods may also be used. Once blending is complete, the gas generant constituents may be extruded or formed into specific shapes such as elongated extrusions, pellets, sheets, or granules.

Table 1 exemplifies the present invention. As shown in the table, compositions consisting of silicone and a perchlorate oxidizer have rapid and sustained burn rates (at 3000 psi) greater than or equal to one inch per second. These combustion properties have been observed at ambient pressure wherein the burn rate is approximately 0.4 inches per second or greater. Nevertheless, the combustion temperatures are relatively high. See Examples 2 and 3. However, when a coolant such as a metal carbonate is added, the temperatures in certain cases are notably reduced. See Examples 17, 21, and 24, for example.

TABLE 1

| Example | Formulation | Mol gas/100 g | Tc @ 3000 psi | Density g/cc | Gas Yield % | Comment |
|---|---|---|---|---|---|---|
| 1 | 82% $Sr(NO_3)_2$<br>18% Silicone | 1.6 | 2100 | 2.20 | 45.2 | Slow ignition and burning; well-formed slag |
| 2 | 79% $KClO_4$<br>21% Silicone | 1.4 | 3182 | 1.90 | 40.8 | Rapid and sustained burn at ambient pressure |
| 3 | 80% $KClO_4$<br>20% Silicone | 1.4 | 3130 | 1.93 | 43.4 | Rapid and sustained burn at ambient pressure |
| 4 | 31% $KClO_4$<br>19% Silicone<br>50% $Sr(NO_3)_2$ | 1.5 | 2100 | 2.08 | 43.2 | Slower ignition and burning than Ex. 2 and 3; well-formed slag |
| 5 | 30% $KClO_4$<br>20% Silicone<br>50% $Sr(NO_3)_2$ | 1.6 | 2100 | 2.05 | 46.7 | Slower ignition and burning than Ex. 2 and 3; well-formed slag |
| 6 | 30% $LiClO_4$<br>22% Silicone<br>48% $Sr(NO_3)_2$ | 1.7 | 2222 | 1.98 | 46.7 | Slower ignition and burning than Ex. 2 and 3; well-formed slag |
| 7 | 20% $LiClO_4$<br>20% Silicone<br>60% $Sr(NO_3)_2$ | 1.6 | 2099 | 2.07 | 46.4 | Slower ignition and burning than Ex. 2 and 3; well-formed slag |

TABLE 1-continued

| Example | Formulation | Mol gas/100 g | Tc @ 3000 psi | Density g/cc | Gas Yield % | Comment |
|---|---|---|---|---|---|---|
| 8 | 29% $LiClO_4$<br>20% Silicone<br>40% $Sr(NO_3)_2$<br>11% $NH_4NO_3$ | 1.9 | 2207 | 1.93 | 52.6 | Burn is slower than non-AN* formulas; higher gas yield |
| 9 | 45% $LiClO_4$<br>20% Silicone<br>35% $NH_4NO_3$ | 2.6 | 2923 | 1.70 | 65.8 | Burn is slower than non-AN formulas; higher gas yield |
| 10 | 27% $LiClO_4$<br>20% Silicone<br>35% $Sr(NO_3)_2$<br>18% $NH_4NO_3$ | 2.2 | 2379 | 1.88 | 55.9 | Burn is slower than non-AN formulas; higher gas yield |
| 11 | 37% $LiClO_4$<br>19% Silicone<br>44% $NH_4NO_3$ | 2.8 | 2841 | 1.67 | 69.8 | Burn is slower than non-AN formulas; higher gas yield |
| 12 | 53% $KClO_4$<br>20% Silicone<br>27% $Sr(NO_3)_2$ | 1.5 | 2594 | 2.00 | 42.0 | Slower ignition and burning than Ex. 2 and 3; well-formed slag |
| 13 | 27% $LiClO_4$<br>20% Silicone<br>36% $Sr(NO_3)_2$<br>17% $NH_4NO_3$ | 2.0 | 2000 | 1.93 | 55.4 | Burn is slower than non-AN formulas; higher gas yield but liberates $H_2$ and CO |
| 15 | 58% $LiClO_4$<br>20% Silicone<br>22% $Na_2CO_3$ | 1.5 | 3291 | 1.90 | 51.0 | Rapid and sustained burn at ambient pressure |
| 16 | 58% $LiClO_4$<br>20% Silicone<br>22% $SrCO_3$ | 1.5 | 2296 | 2.00 | 47.5 | Rapid and sustained burn at ambient pressure |
| 17 | 58% $LiClO_4$<br>20% Silicone<br>22% $CaCO_3$ | 1.5 | 2100 | 1.95 | 51.8 | Rapid and sustained burn at ambient pressure |
| 18 | 71% $LiClO_4$<br>19% Silicone<br>10% $C_3H_6N_6$ | 1.9 | 3161 | 1.83 | 56.2 | |
| 19 | 49% $KClO_4$<br>21% Silicone<br>30% $Sr(NO_3)_2$ | 1.5 | 2633 | 1.98 | 41.9 | Slower ignition burning than Ex. 2 and 3; well-formed slag |
| 20 | 20% Silicone<br>80% $NH_4NO_3$ | 3.4 | 3094 | 1.64 | 83.8 | Burn is slower than non-AN formulas; higher gas yield but liberates $H_2$, HCl, CO |
| 21 | 58% $LiClO_4$<br>20% Silicone<br>22% $CaC_2O_4$ | 1.6 | 2277 | 1.86 | 53.7 | Rapid and sustained burn at ambient pressure |
| 22 | 51% $LiClO_4$<br>22% Silicone<br>27% $NH_4NO_3$ | 2.4 | 3007 | 1.7 | 61.9 | Burn is slower than non-AN formulas; higher gas yield but liberates $H_2$, and CO |
| 23 | 10% $KClO_4$<br>20% Silicone<br>70% $Sr(NO_3)_2$ | 1.6 | 2100 | 2.11 | 55.9 | Slower ignition and burning than Ex. 2 and 3; well-formed slag |
| 24 | 60% $KClO_4$<br>20% Silicone<br>20% $SrCO_3$ | 1.5 | 2363 | 2.03 | 37.5 | Rapid and sustained burn at ambient pressure |

In general, compositions containing ammonium nitrate and/or other metal nitrates or secondary oxidizers in amounts greater than 50% by weight of the gas generant composition did not exhibit sufficient burn rates (0.4 inches per second or greater) at ambient pressure. Strontium salts that are not oxidizers are preferred given the greater cooling effect. Compare Examples 19 and 24.

Furthermore, in accordance with the present invention, certain compositions exhibit relatively higher temperatures than a preferred embodiment containing silicone, strontium carbonate and potassium perchlorate, for example, but still sustained rapid combustion at ambient pressure. As a result, these compositions are still desirable from the perspective that a less robust inflator is required.

Combustion properties may be tailored by adding known ballistic modifiers and catalysts if desired.

The gas generant constituents of the present invention are available from well-known sources such as Fisher Chemical or Aldrich. The silicone polymers may be purchased, for example, from General Electric in Waterford, N.Y.

The compositions of the present invention are useful in many applications requiring gas generation. These compositions have particular utility as gas generant compositions that may be combusted to inflate an airbag in a vehicle occupant protection system, for example.

While specific embodiments have been described in detail, those with ordinary skill in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of any claims which are derivable from the description herein, and any and all equivalents thereof.

We claim:

1. A gas generant composition consisting essentially of:

silicone as a fuel at about 10–25% by weight;

an oxidizer selected from the group consisting of metal and nonmetal perchlorates at about 30–85% by weight; and a coolant selected from the group consisting of alkali, alkaline earth, and transitional metal carbonates, bicarbonates, oxalates, and hydroxides at about 1–30% by weight, said percentages stated by weight of the gas generant composition.

2. The gas generant composition of claim 1 wherein said oxidizer is selected from the group consisting of potassium perchlorate, ammonium perchlorate, and lithium perchlorate.

3. The gas generant composition of claim 1 wherein said composition consists essentially of:

silicone as said fuel;

potassium perchlorate as said oxidizer; and strontium carbonate as said coolant.

4. The gas generant composition of claim 1 wherein said composition consists essentially of:

silicone as said fuel;

potassium perchlorate as said oxidizer; and strontium oxalate as said coolant.

5. The gas generant composition of claim 1 wherein said composition consists essentially of:

silicone as said fuel;

potassium perchlorate as said oxidizer; and calcium oxalate as said coolant.

6. The gas generant composition of claim 1 wherein said composition consists essentially of:

silicone as said fuel;

potassium perchlorate as said oxidizer; and calcium carbonate as said coolant.

7. The gas generant composition of claim 1 wherein said composition consists essentially of:

silicone as said fuel;

potassium perchlorate as said oxidizer; and magnesium hydroxide as said coolant.

8. The gas generant composition of claim 1 wherein said composition consists essentially of:

silicone as said fuel;

potassium perchlorate as said oxidizer; and magnesium carbonate as said coolant.

9. The gas generant composition of claim 1 wherein said composition consists essentially of:

silicone as said fuel;

lithium perchlorate as said oxidizer; and a coolant selected from the group consisting of strontium carbonate, calcium carbonate, strontium oxalate, magnesium carbonate, magnesium hydroxide, and potassium carbonate.

10. A gas generant composition consisting essentially of:

silicone as a fuel at 20–25%;

a primary oxidizer selected from the group consisting of metal and nonmetal perchlorates at 30–60%; and a coolant selected from the group consisting of alkali, alkaline earth, and transitional metal carbonates, oxalates, bicarbonates, and hydroxides at 20–30%, said percentages stated by weight of said gas generant composition.

11. A gas generant composition consisting essentially of:

silicone as a fuel at 10–25%;

potassium perchlorate as a primary oxidizer at 30–85%; and a coolant selected from the group consisting of alkali metal, alkaline earth metal, and transitional metal carbonates, oxalates, and hydroxides at 1–30%, said percentages stated by weight of said gas generant composition.

12. The gas generant composition of claim 11 consisting essentially of:

silicone as said fuel at 10–25%;

potassium perchlorate as said oxidizer at 30–85%; and strontium carbonate as said coolant at 1–30%, said percentages stated by weight of said gas generant composition.

13. The gas generant composition of claim 12 comprising:

silicone as said fuel at 20%;

potassium perchlorate as said oxidizer at 60%; and strontium carbonate as said coolant at 20%, said percentages stated by weight of said gas generant composition.

* * * * *